US005140787A

United States Patent [19]

Corcoran

[11] Patent Number: 5,140,787

[45] Date of Patent: * Aug. 25, 1992

[54] HIGH DENSITY STORAGE FACILITY

[76] Inventor: John Corcoran, Dennis, Mass. 02638

[ * ] Notice: The portion of the term of this patent subsequent to Nov. 5, 2008 has been disclaimed.

[21] Appl. No.: 642,805

[22] Filed: Jan. 18, 1991

Related U.S. Application Data

[63] Continuation of Ser. No. 378,156, Jul. 10, 1989, Pat. No. 5,062,242.

[51] Int. Cl.[5] ..... E04H 3/04; A47B 5/00; A47B 53/00

[52] U.S. Cl. ..... 52/36; 52/33; 52/79.3; 414/281; 312/198

[58] Field of Search ..... 52/36, 234, 79.3, 33; 312/198; 414/281, 284, 331

[56] References Cited

U.S. PATENT DOCUMENTS

| | | | |
|---|---|---|---|
| 2,166,704 | 7/1939 | Foulkes | 214/16 |
| 2,174,260 | 9/1939 | Foulkes | 312/201 |
| 2,927,696 | 3/1960 | Michaels, III et al. | 211/27 |
| 3,731,758 | 5/1973 | Hibma | 180/11 |
| 3,890,963 | 4/1974 | Holland | 414/281 |
| 4,229,135 | 10/1980 | Malmros | 414/284 |
| 4,307,922 | 12/1981 | Rhodes, Jr. | 312/198 |
| 4,773,809 | 9/1988 | Peterson et al. | 414/331 |
| 4,806,072 | 2/1989 | Karashima | 414/786 |

FOREIGN PATENT DOCUMENTS

| | | |
|---|---|---|
| 576627 | 6/1943 | United Kingdom . |
| 881568 | 1/1958 | United Kingdom . |
| 2062450 | 5/1981 | United Kingdom . |

*Primary Examiner*—James L. Ridgill, Jr.
*Attorney, Agent, or Firm*—M. Lawrence Oliverio

[57] ABSTRACT

A high density storage facility comprising: a building enclosing a rectangular floor area of certain length and width; a plurality of rectangular storage racks of certain height divided from top to bottom into storage slots, the slots extending the rectangular length of the racks and being open and accessible for inserting and removing objects into and from the width ends of the racks; the racks being disposed within the enclosed rectangular floor area and including a mechanism for rolling the racks along the floor area; the building including a wall disposed substantially parallel to a lengthwise side of the rectangular floor area, the wall including doors selectively disposed along the length of the wall for providing access to all of the width ends of all of the racks; the racks being rollably movable along the length of the enclosed rectangular floor area for providing access to the width ends of the racks from the doors.

28 Claims, 12 Drawing Sheets

HIGH DENSITY STORAGE FACILITY

This application is a continuation of application Ser. No. 07/378,156 filed Jul. 10, 1989 now U.S. Pat. No. 5,062,242 issued Nov. 5, 1991.

BACKGROUND OF THE INVENTION

The present invention relates to high density storage facilities and more particularly to a high density storage facility for storing boats.

Despite advances in building materials and techniques, cost effective facilities for storing large sized objects such as boats, cars, furniture and the like and providing mechanisms for obtaining ready and efficient access to the stored objects have not been developed. For example with respect to boat storage, conventional facilities typically comprise an oversized building with racks aligned along the walls of the building and a large unoccupied floor space extending the length of the building. The cost of the land and construction of the building often does not justify the income which storage fees may reasonably generate.

It is therefore an object of the invention to provide a cost effective, high density storage facility which provides ready and efficient access to the space within the facility where objects may be stored.

SUMMARY OF THE INVENTION

In accordance with the invention there is provided a high density storage facility comprising a building enclosing a rectangular floor area of certain length and width; a plurality of rectangular storage racks of certain height divided from top to bottom into storage slots, the slots extending the rectangular length of the racks and being open and accessible for inserting and removing objects into and from the width ends of the racks; the racks being disposed within the enclosed rectangular floor area and including a mechanism for rolling the racks along the floor area; the building including a wall disposed substantially parallel to a lengthwise side of the rectangular floor area, the wall including doors selectively disposed along the length of the wall for providing access to all of the width ends of all of the racks; the racks being rollably movable along the length of the enclosed rectangular floor area for providing access to the width ends of the racks from the doors.

The racks are typically arranged in rows within the rectangular floor area, the lengthwise sides of the racks being arranged substantially parallel to the lengthwise sides of the rectangular floor area, the rows comprising a plurality of side by side racks which collectively fit within and across the width of the floor area. The racks comprising a row are preferably connected along their lengthwise sides forming rows which are rollably movable in a lengthwise direction along the floor area.

Most preferably the racks are mounted on tracks for lengthwise movement within the rectangular floor area, the tracks extending the length of the floor area in a direction substantially parallel to the wall of the building. Typically at least two rows of racks are disposed within the enclosed rectangular floor area and as many rows of racks are disposed within the enclosed floor area as will fit along the length of the floor area and leave a portion of the floor area unoccupied which is of a size at least sufficient to provide access from the doors to the width ends of the racks upon selective movement of the rows along the length of the floor.

The doors are selectively disposed along the wall of the building so as to provide access to the unoccupied floor area upon selective movement of one or more of the rows of racks along the length of the floor area. Most preferably the unoccupied floor area is further selected to be of such a size as to accommodate manipulation of the objects within the unoccupied floor area for insertion into the slots. And, the unoccupied floor area is further typically selected to be of such a size as to be accessible to the doors upon movement of one or more of the rows of racks along the length of the floor area.

Most preferably, a facility according to the invention includes motor mechanisms for drivably moving the racks across the length of the floor area. The facility may include a row of stationary racks arranged along one or both of the lengthwise sides of the rectangular floor area, the stationary racks having a certain length, width and height and being divided from top to bottom into storage slots. the slots extending the length of the racks and being open and accessible from one width end for inserting and removing objects, the width ends of the racks facing the rectangular floor area.

A row of racks typically comprises a series of spaced vertical supports interconnected by a series of spaced horizontal supports. And, the horizontal supports are typically adjustable in position along the height of the vertical supports.

DETAILED DESCRIPTION OF PREFERRED EMBODIMENTS

Figure 1:
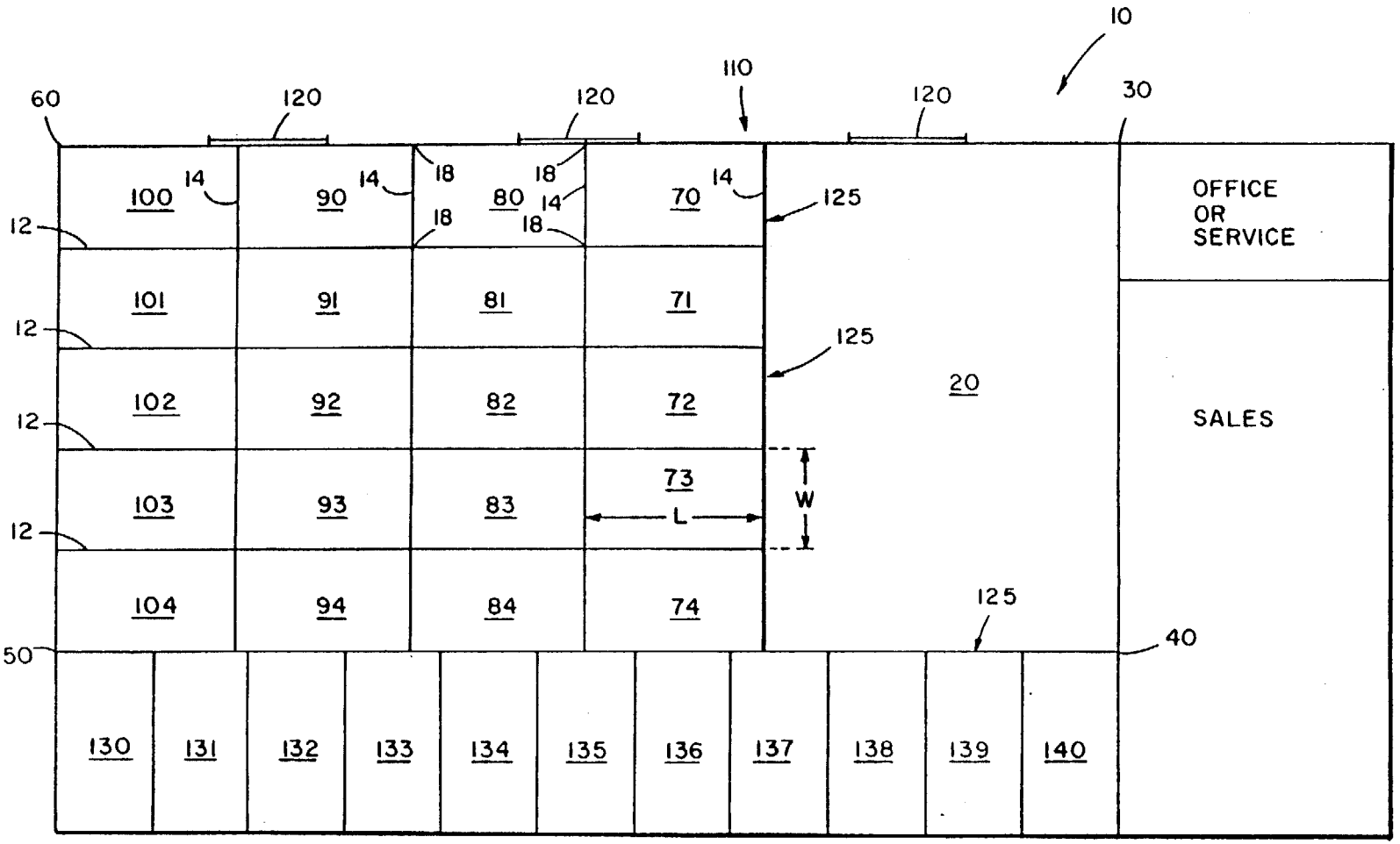
FIGS. 1 to 11 are exemplary embodiments of a floor plan of the invention.
Figure 2:
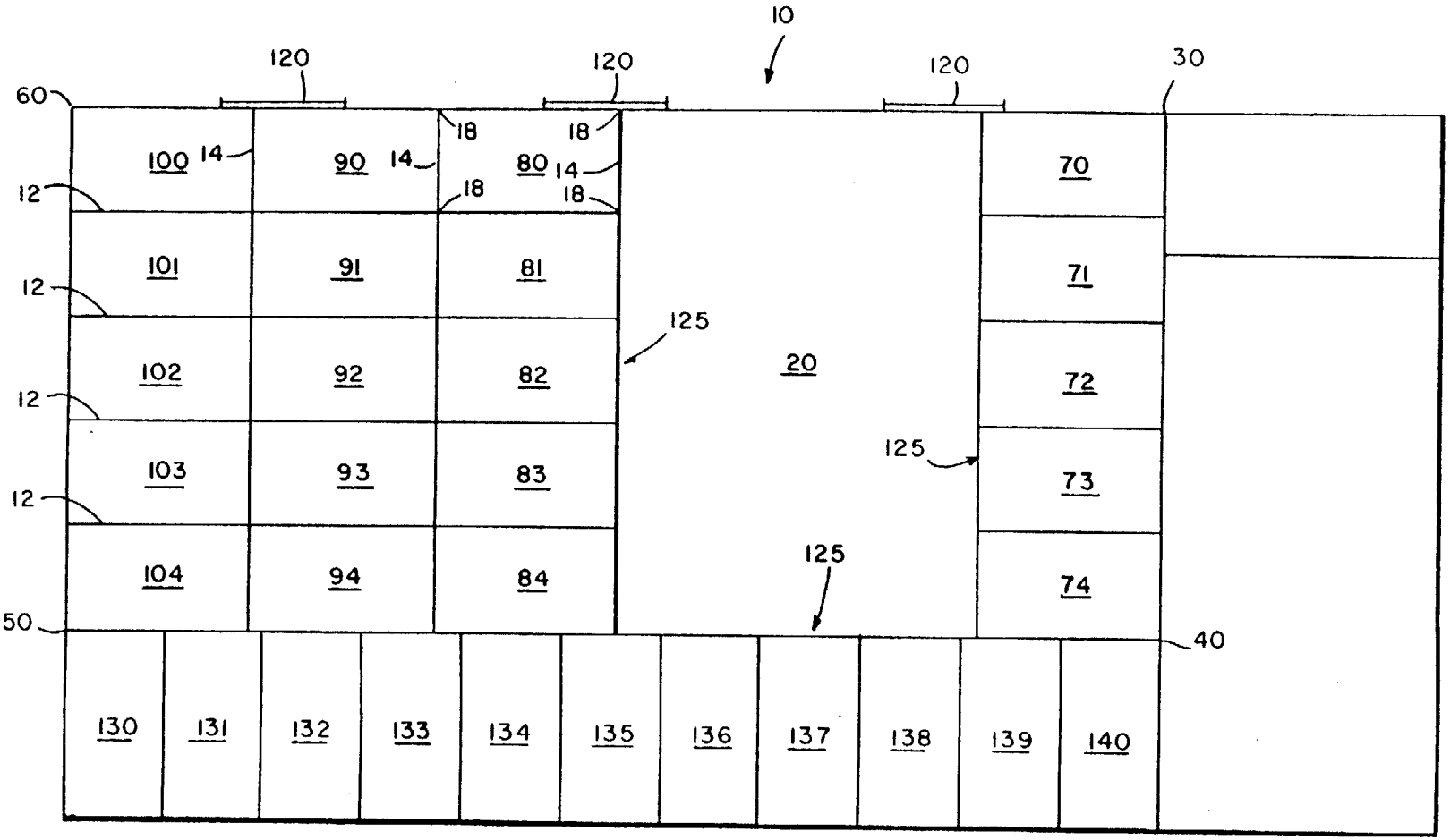
Figure 3:
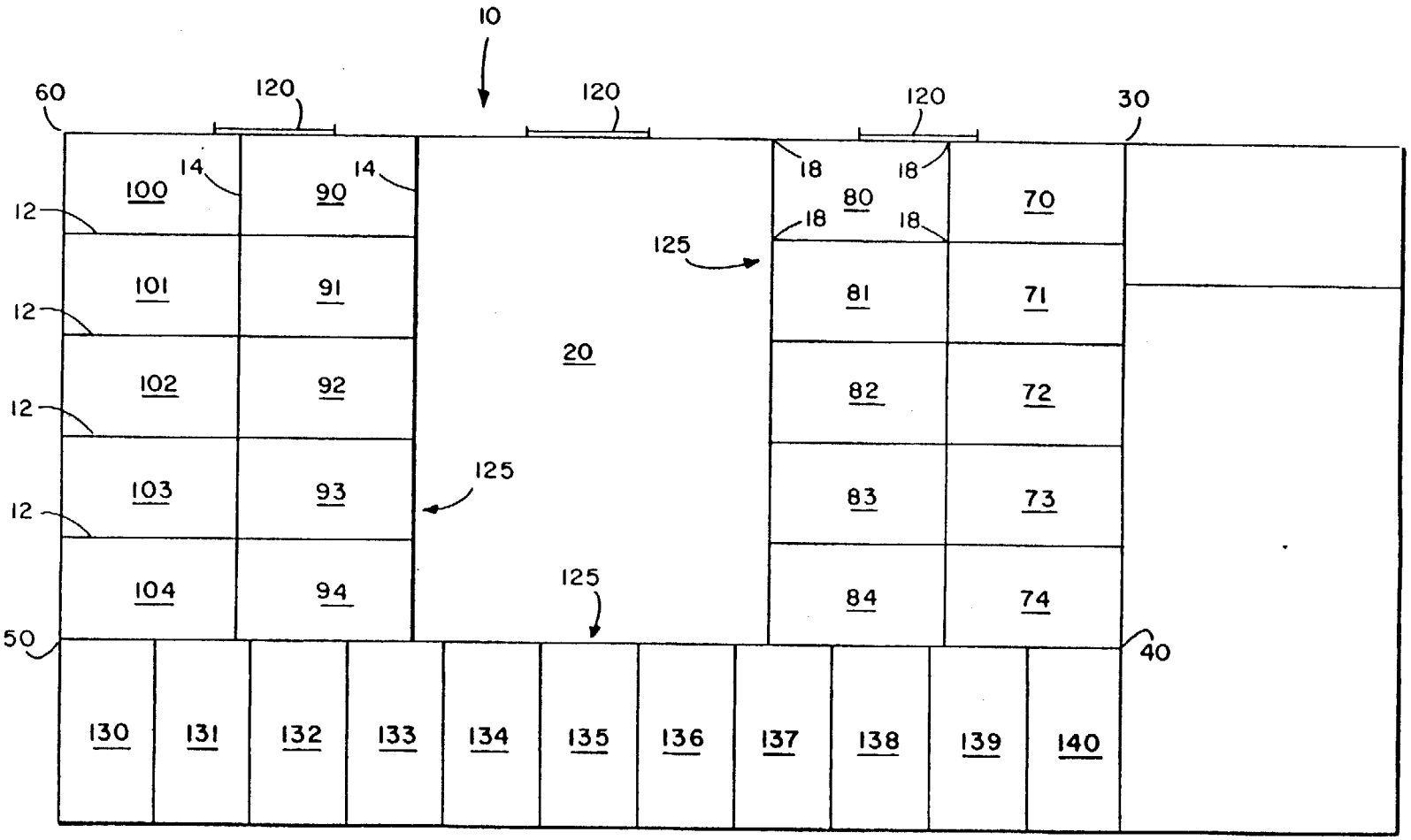
Figure 4:
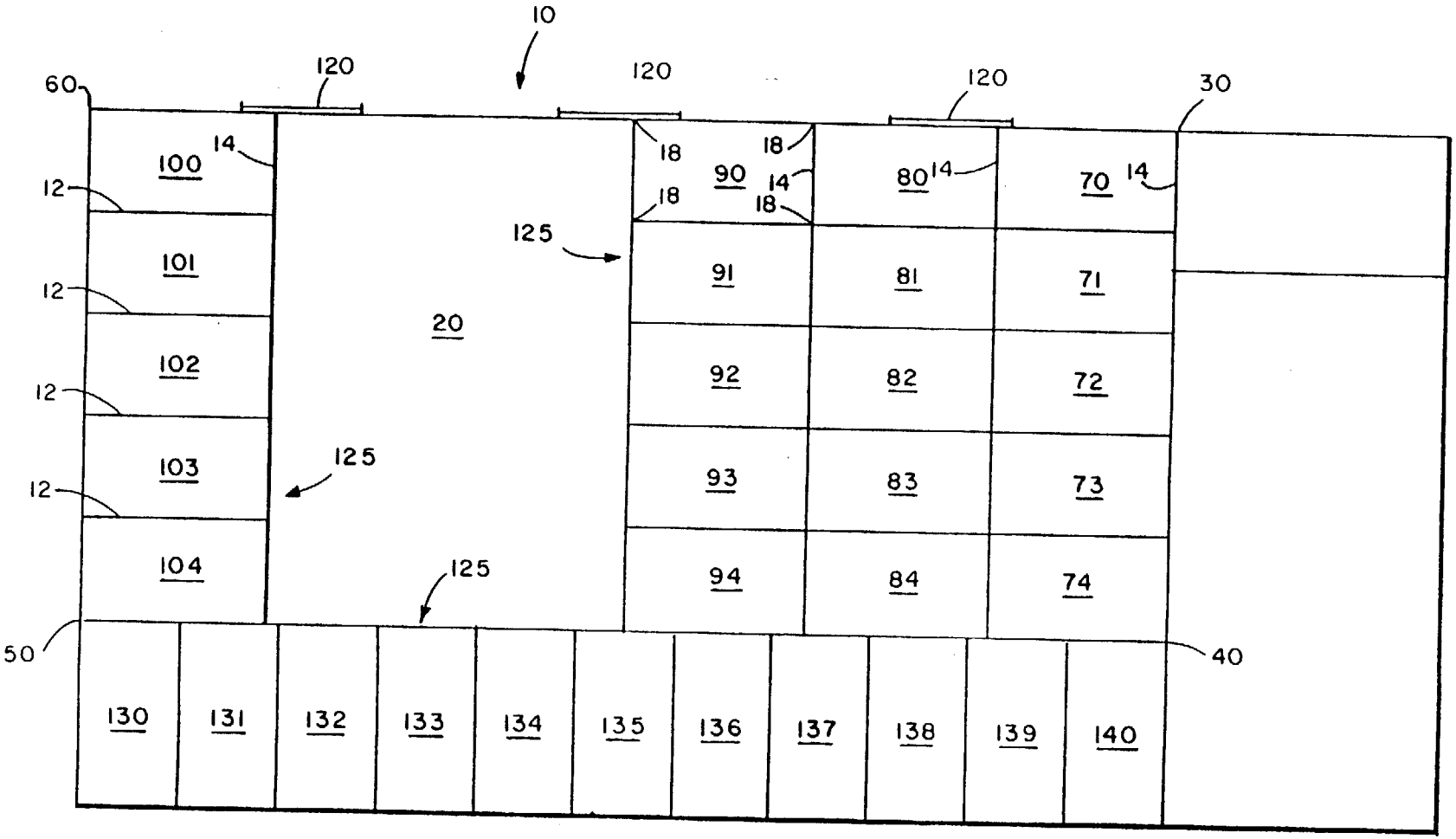
Figure 5:
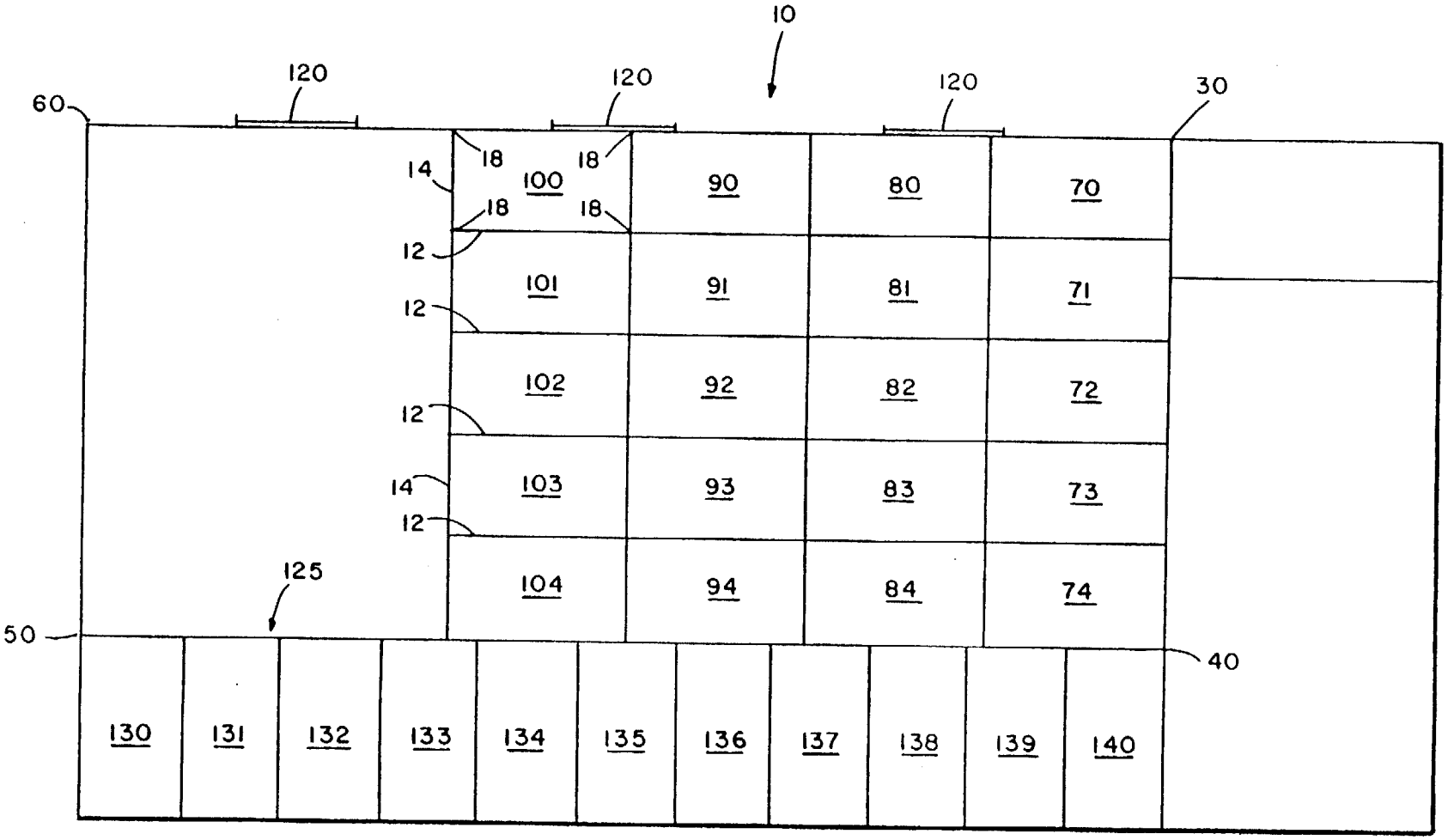
Figure 6:
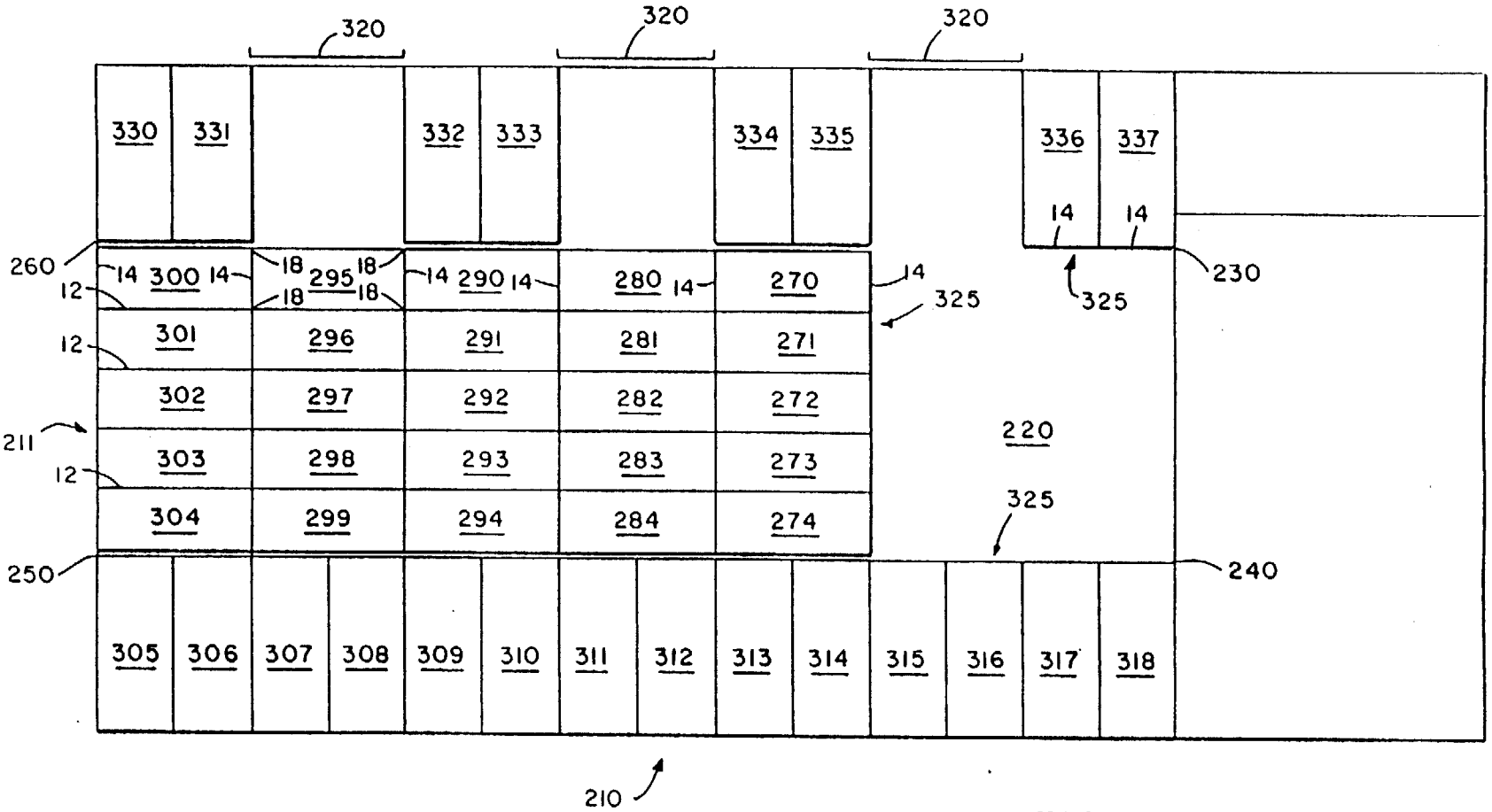
Figure 7:
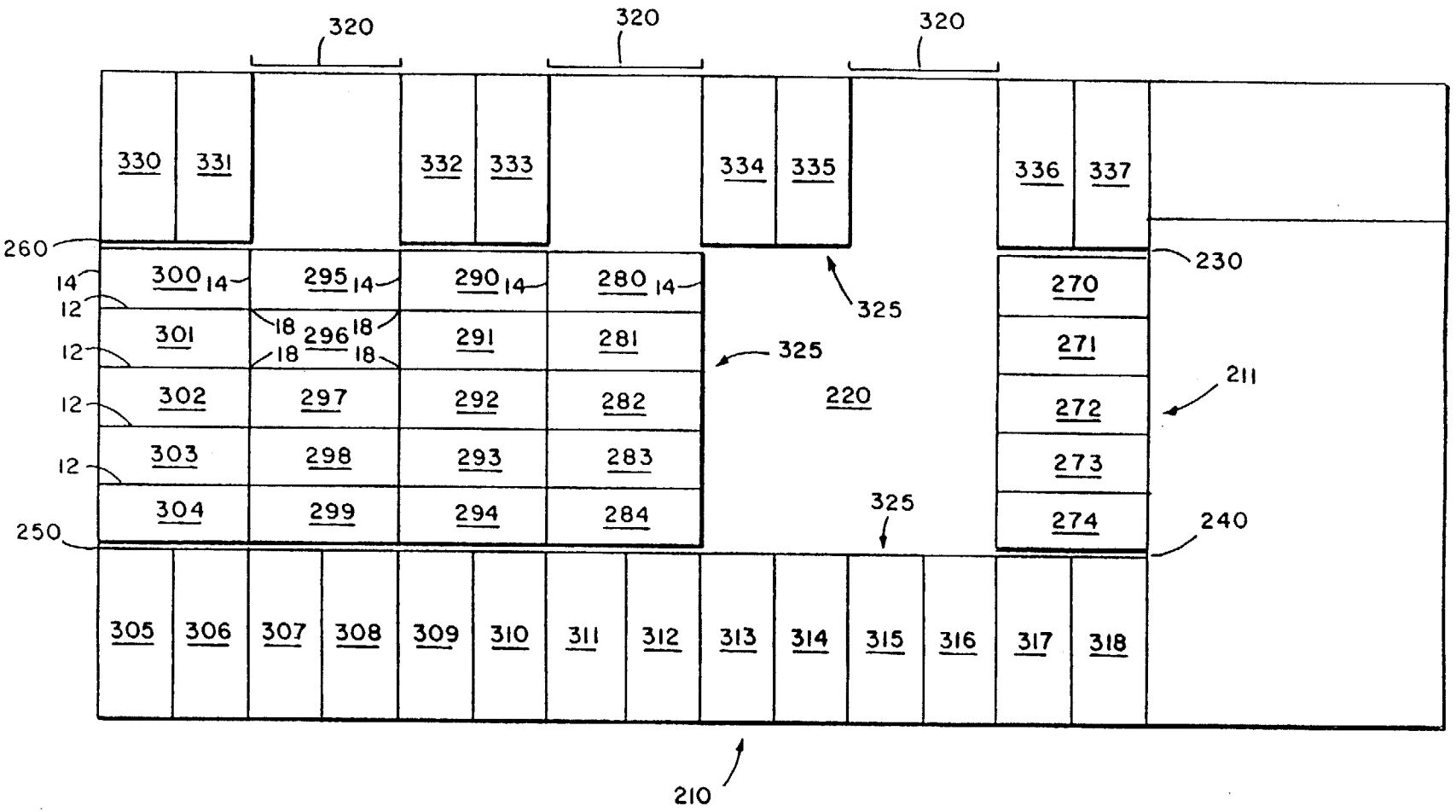
Figure 8:
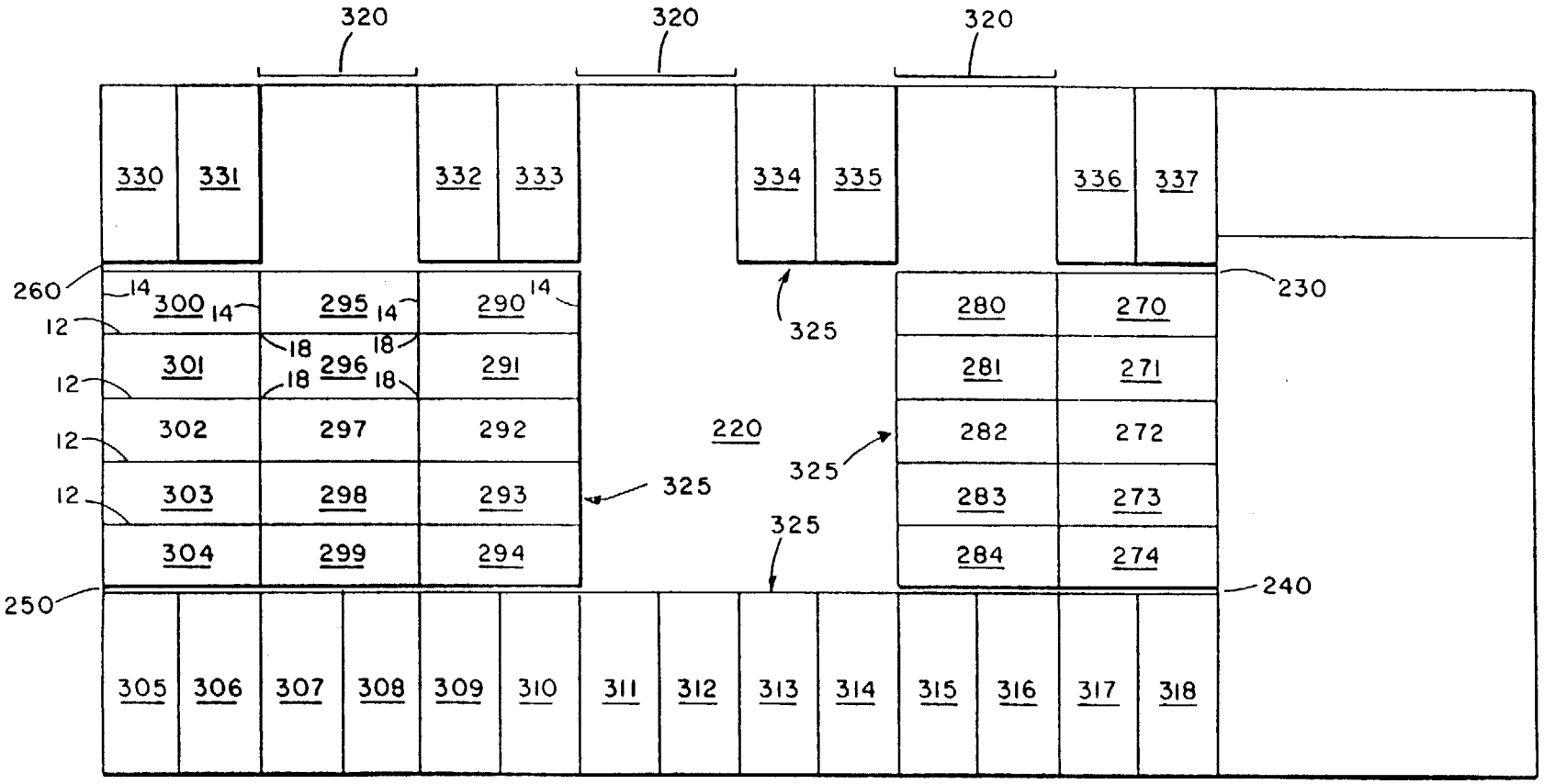
Figure 9:
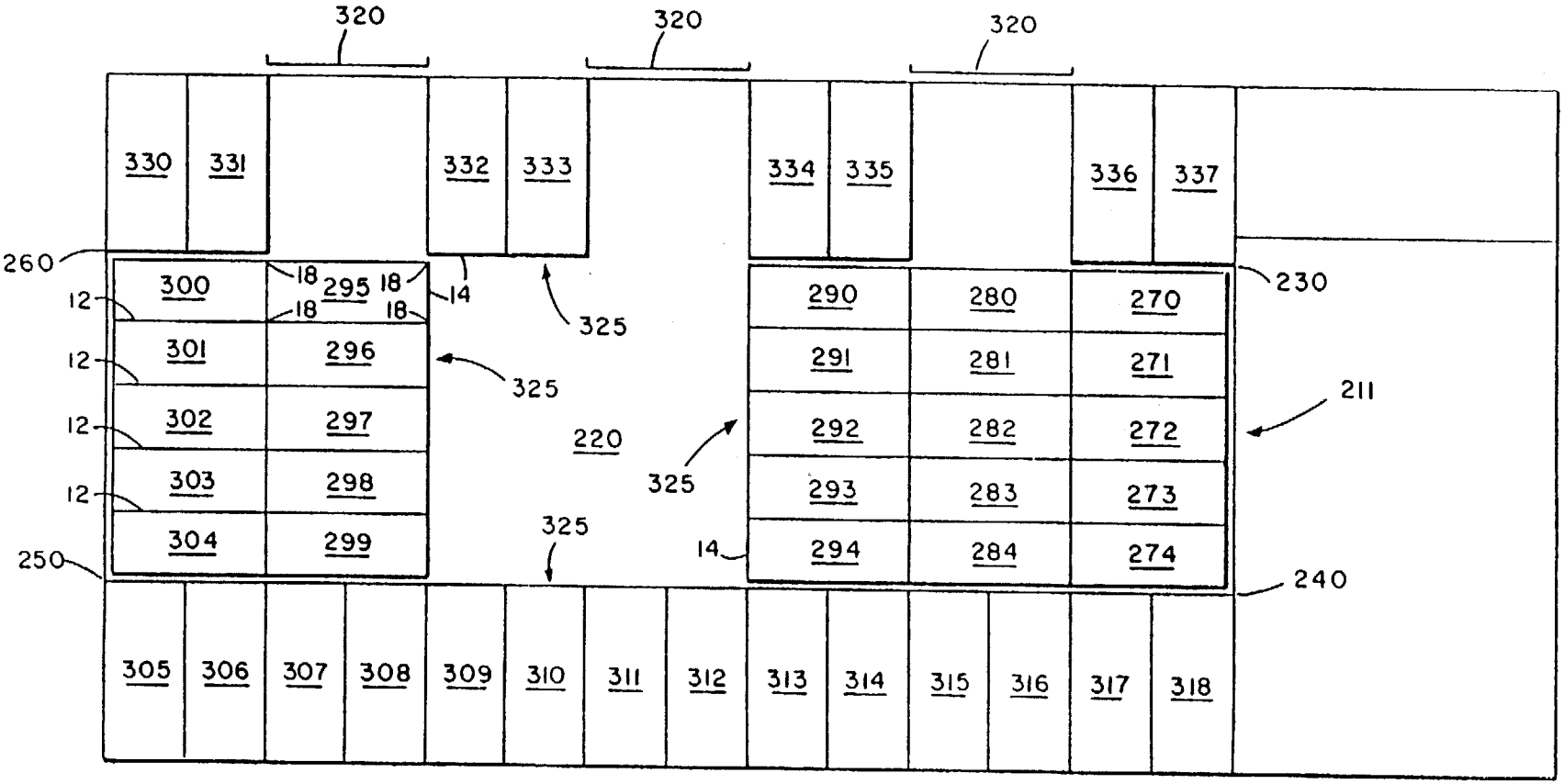
Figure 10:
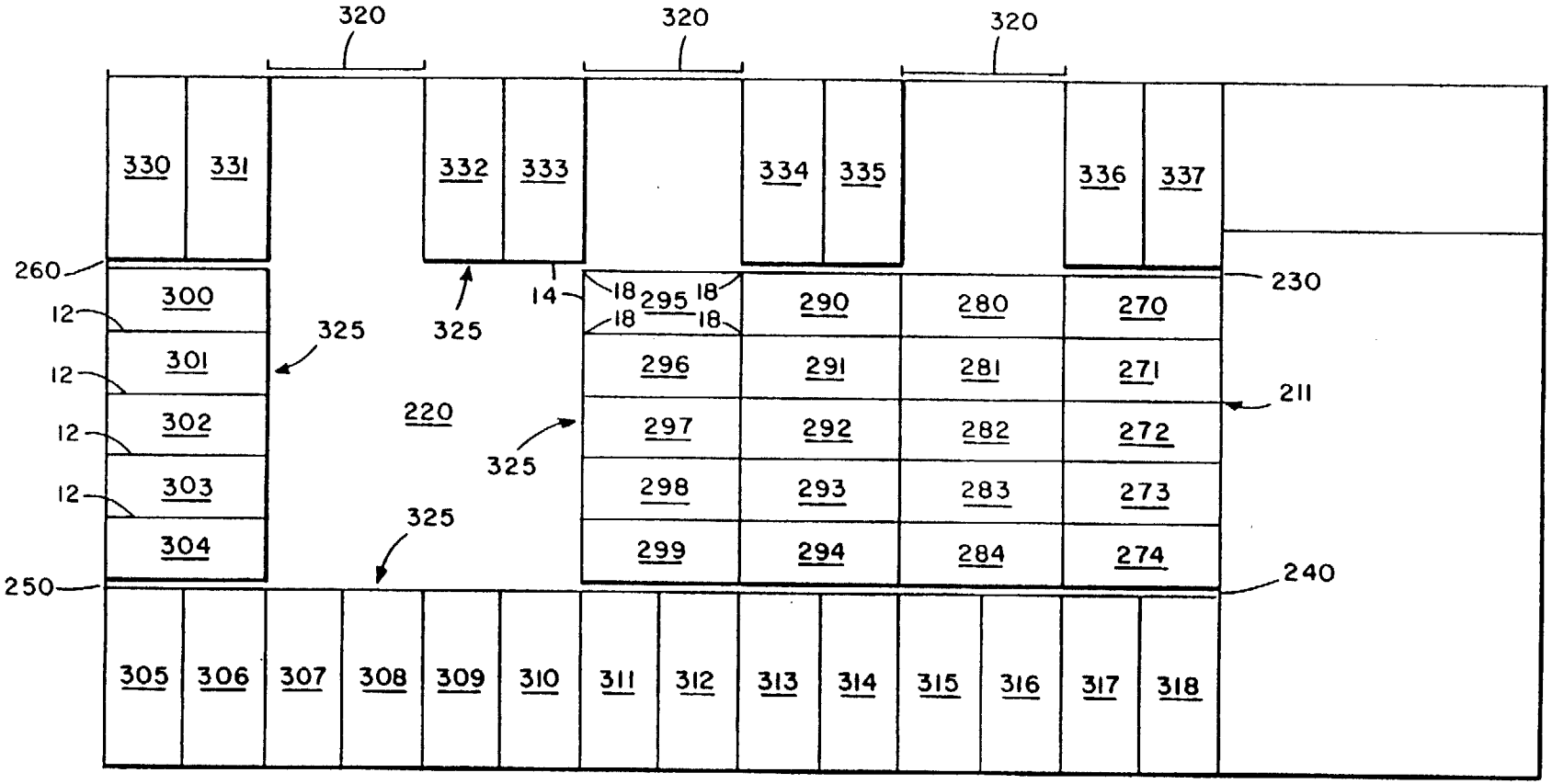

The following description sets forth typical embodiments of the invention, it being understood that other embodiments not specifically described herein are encompassed by the invention.

FIGS. 1–5 show the overall floor plan of a typical boat storage, service and sales facility 10. A rectangular floor area 110 which is defined by lines connecting points 30, 40, 50, 60 is provided. For purposes of the invention discussion herein, the term rectangular also includes square.

A plurality of movable racks 70–74, 80–84, 90–94 and 100–104 are arranged as shown in rows within rectangular floor area 110, each row comprising as many individual racks as will fit across and within the width (i.e. the distance between points 30, 40 and 50, 60) of area 110. As shown in FIGS. 1–5, each row comprises as many racks (5) as possible as will fit within the width of area 110, in the embodiment shown in FIGS. 1–5 (and in FIGS. 6–10 as described below) filling the entire width of the area 110 for purposes of maximum space utilization.

Each row 70–74, 80–84, 90–94, and 100–104 of racks is movable lengthwise along the length of area 110. The rows are typically mounted on wheels 11 (FIG. 12) which are in turn mounted in tracks 12 which extend the length of area 110. The wheels 11 are typically mounted at the bottom of both lengthwise ends of each rack and a series of spaced parallel tracks 12 are provided along the width of the area 110 to coincide with the wheel of displacement. Each rack of each row is rectangular (in cross-section) and has a certain length L and width W. In the embodiments shown in FIGS. 1-10, all of the racks have the same length and width, although as described in an exemplary embodiment shown in FIG. 11, the lengths and widths of individual racks may vary within and between rows, in which event the widthwise disposition of wheels and complementary tracks 12 will not necessarily coincide with the widths of each individual rack. The tracks in any event preferably extend the length of area 110, i.e. between the line connecting points 50, 60 and points 30, 40.

Each rack is divided into slots 14 from top to bottom. The total height of the racks is typically between about 12 and about 35 feet, the upper limit in height being somewhat dependent on local zoning restrictions concerning the height of a building in which the apparatus would reside. In a preferred embodiment of the invention each row of racks is a unitary structure comprising a series of parallel vertically oriented supports 18 connected from top to bottom by a series of parallel horizontal 19 supports. In such a preferred embodiment, conventional mechanisms are typically provided for adjusting a horizontal support up and down along the vertical supports, 18 (FIG. 12) typically in increments of about 3 inches. The vertical distance between successive horizontal supports defines the slot height and the horizontal distance between successive vertical supports 18 defines slot width.

Along one wall of the facility are disposed a series of doors 120. An unoccupied service and loading area 20 is provided, the size of which is determined in combination with the selection of where doors 120 are disposed along the outer wall such that when a row 70-74, 80-84, 90-94 or 100-104 of racks is appropriately moved along the floor area 110, enough floor area 20 is left unoccupied so as to enable the user to gain access to all of the width ends 125 of each row. As shown in FIGS. 1-5, the unoccupied floor area 20 is large enough relative to the displacement of doors 120 so as to enable a user of the facility to always gain access to the width ends 125 of all rows by moving one or more rows sufficiently to enable a user to always gain access through a door 120 to the width ends 125 of any particular row. Objects to be stored in the slots are inserted via the width ends 125 of the racks.

As shown in FIGS. 1-5 a stationary row of racks 130-140 along a wall are also typically provided to maximize storage utilization in the facility. As shown the width ends 125 of all of racks 130-140 are also accessible through at least one door 120 by appropriate movement of rows 70-74, 80-84, 90-94 and 100-104 along the length of area 110.

In another exemplary embodiment of the invention shown in FIGS. 6-10, another row of racks 330-337 may be provided along the length of the same wall of facility 210 in which doors 320 are disposed. In the same manner as described above with reference to facility 10, FIGS. 1-5, facility 210, FIGS. 6-10 is provided with an unoccupied loading space 220, successive rows of racks 270-274, 280-284, 290-304 which are movable along the length of an area 211 defined by lines between points 230, 240, 250, 260, and a stationary row of racks 305-318 along an outer doorless wall. As can be seen from FIGS. 6-10 the width ends 325 of all of racks 270-337 are also available by access through at least one of doors 320. Similarly, as described with reference to the FIGS. 1-5 embodiments, the FIGS. 6-10 movable racks 270-304 all have the same length and width and the individual slots thereof are adjustable in height.

Another consideration in selecting the size of the unoccupied floor area 20, 220, FIGS. 1-10, is that it must be at least large enough to allow the objects to be stored in the slots 14 (FIG. 12) of the racks to be manipulated into the width ends 125, 325 of the racks. For example, where a facility 10, 210 is to be used for storage of boats, typical boat lengths are from 5 to 35 feet in length and are maneuvered into an area 20, 220 by use of a forklift. Depending on the length of the longest slot among all of the racks, the length and width of the unoccupied floor space 20, 220 should be at least about 5-15 feet longer than the length of the longest slot 14 in order to enable a forklift to align itself parallel to the length of the racks for insertion and removal of the boat(s) into and from the width ends 125, 325 of the racks.

Figure 11:
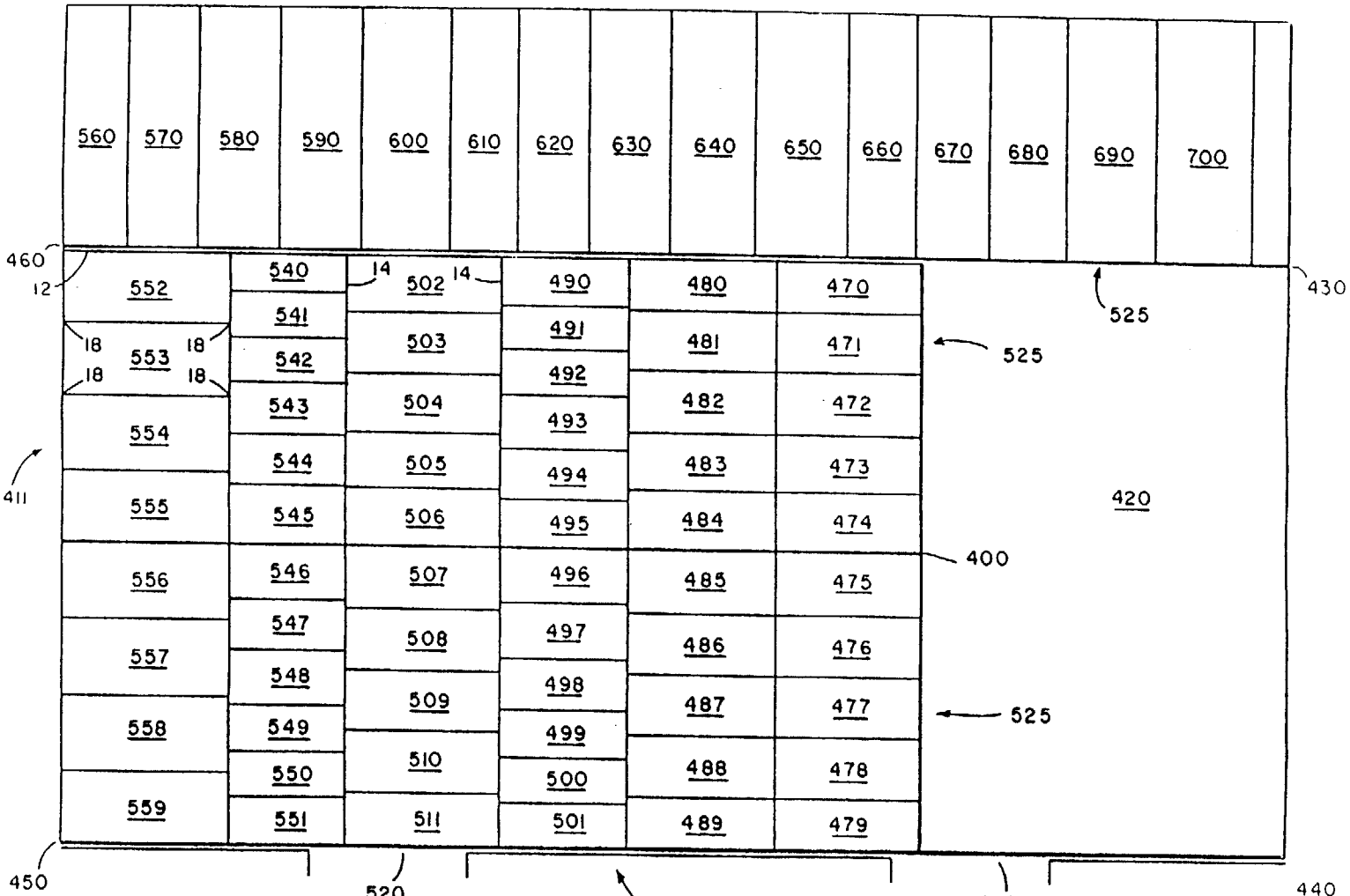

In another exemplary embodiment shown in floor plan in FIG. 11, the lengths and widths of movable racks 470-559 may vary among different movable rows provided within a facility 410. As described with reference to FIGS. 1-10, the facility 410, FIG. 11, is similarly provided with an unoccupied area 420 of at least a size sufficient to obtain access through an appropriate door 520 to all of the width ends 525 of all of the racks 470-700 upon appropriate lengthwise movement of successive rows of racks within a floor area 411 defined by lines between points 430, 440, 450, 460. As shown, the FIG. 11 facility 410 is provided with a stationary row of racks 560-700 also having varying widths aligned along a doorless wall.

Figure 12:
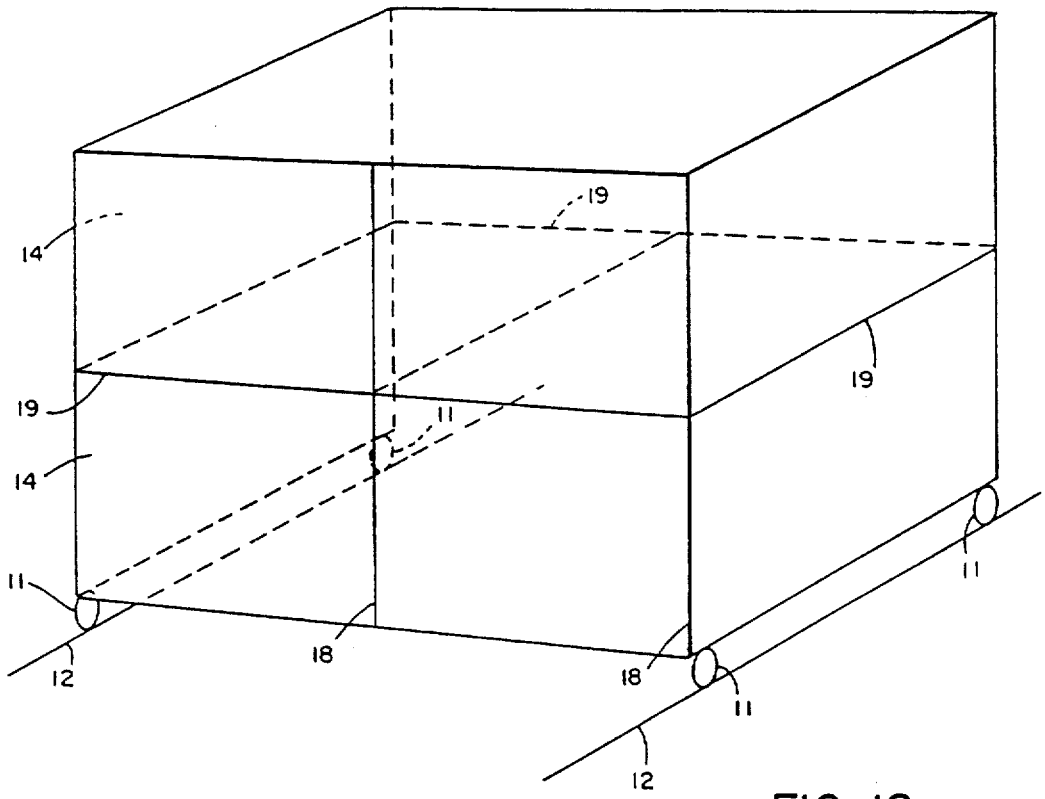
FIG. 12 is a schematic view of the vertical and horizontal supports, the slots, the wheels, and the means for rolling the rack along the floor.

As shown in FIG. 12, a schematic front view of a row of racks, the row is divided into slots 14 by vertical supports 18 and by horizontal supports 19. The rack extends across the entire width of a selected defined floor space, e.g. between points 230, 240 and 250, 260 in FIGS. 1-6. As shown schematically, the movable row of racks in FIG. 12 is mounted on rollable wheels 11 which, in turn, would be mounted within complementary tracks 12 provided on the defined floor surface.

In preferred embodiments of the invention the stationary rows of racks 130-140, FIGS. 1-5, 305-318, 330-337, FIGS. 6-10 and 560-700, FIG. 11 are aligned such that their width ends 125, 325, 525 face the lengthwise side(s) of areas 110, 211, 411 and are substantially perpendicular thereto. The stationary racks are typically larger, lengthwise or widthwise or both, than the movable racks for purposes of ease of loading, unloading and storage of larger objects. Also as shown in FIGS. 1-11 the movable racks 70-104, 270-304 and 470-559 are typically aligned such that their lengthwise dimensions are substantially parallel to the lengthwise dimension of areas 110, 211, 411.

In preferred embodiments of the invention, conventional motor means are provided to drive the movable rows of racks along the lengths of areas 110, 211, 411, FIGS. 1-11. Conventional remote control means for the motor means are typically provided for access to the user outside of areas 110, 211, 411 typically outside such as on the outside surfaces of the walls in which access doors 120, 320, 520 are disposed. The user can thus drivably move the rows of racks remotely from outside areas 20, 110, 211, 220, 411, 420.

Typically each individual row of racks is separately drivable and the remote motor control is provided with conventional means for separately driving each row independent of another row. When the user wants to gain access to the width ends of any particular movable row or stationary rack, the user can thus separately drive individual rows to move them, to appropriate positions within areas 110, 211, 411 whereby access to the width ends of any desired rack can be obtained. And, the user can obtain such access by remote control.

In embodiments where a facility according to the invention is to be used for boat storage, the size of the overall boat storage and service areas is at least about 5,000 square feet, the racks typically have a length of between about 5 and about 40 feet and a width of between about 5 and about 15 feet. And, a facility according to the invention is also typically housed by four walls and a roof. Areas 20, 220, 420 typically serve at least dual purposes for loading/unloading and for servicing a boat or other object indoors such as cleaning and repair.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A high density storage facility comprising:

an enclosed rectangular floor area of certain length and width;

a plurality of rectangular storage racks of certain height divided from top to bottom into storage slots, the slots extending the rectangular length of the racks and being open and accessible for inserting and removing objects into and from the width ends of the racks;

the racks being disposed within the enclosed rectangular floor area and including means for rolling the racks along the floor area, said racks are arranged in rows within the rectangular floor area with the lengthwise sides of the racks being arranged substantially parallel to the lengthwise sides of the rectantular floor area, said rows comprising a plurality of side by side racks which collectively fit within and across the width of the floor area;

a wall disposed substantially parallel to a lengthwise side of the rectangular floor area, the wall including door means selectively disposed along the length of the wall for providing access to all of the width ends of all the racks;

the racks being rollably moveable along the length of the enclosed rectangular floor area for providing access to the width ends of the racks from the door means.

2. The facility of claim 1 further comprising motor means for drivably moving the racks across the length of the floor area.

3. The facility of claim 1 further comprising motor means for drivably moving the racks across the length of the floor area.

4. The facility of claim 1 further comprising a row of stationary racks arranged along one or both of the lengthwise sides of the rectangular floor area, the stationary racks having a certain length, width and height and being divided from top to bottom into storage slots, the slots extending the length of the racks and being open and accessible from one width end for inserting and removing objects into and from the width ends of the stationary racks, the width ends of the racks facing the rectangular floor area.

5. The facility of claim 1 further comprising a row of stationary racks arranged along one or both of the lengthwise sides of the rectangular floor area, the stationary racks having a certain length, width and height and being divided from top to bottom into storage slots, the slots extending the length of the racks and being open and accessible from one width end for inserting and removing objects into and from the width ends of the stationary racks, the width ends of the racks facing the rectangular floor area.

6. The facility of claim 4 wherein at least two rows of racks are disposed within the enclosed rectangular floor area and wherein as many rows of racks are disposed within the enclosed floor area as will fit along the length of the floor area and leave a portion of the floor area unoccupied which is of a size at least sufficient to provide access from the door means to the width ends of the racks upon selective movement of the rows along the length of the floor.

7. The facility of claim 6 wherein the door means are selectively disposed along the wall of the building so as to provide access to the unoccupied floor area upon selective movement of one or more of the rows of racks along the length of the floor area.

8. The facility of claim 6 wherein the unoccupied floor area is further selected to be of such a size as to accommodate manipulation of the objects within the unoccupied floor area for insertion into the slots.

9. The facility of claim 1 wherein the racks are mounted on tracks for lengthwise movement within the rectangular floor area, the tracks extending the length of the floor area in a direction substantially parallel to the wall of the building.

10. The facility of claim 4 further comprising motor means for drivably moving the racks across the length of the floor area.

11. The facility of claim 4 wherein at least two rows of racks are disposed within the enclosed rectangular floor area and wherein as many rows of racks are disposed within the enclosed floor area as will fit along the length of the floor area and leave a portion of the floor area unoccupied which is of a size at least sufficient to provide access from the door means to the width ends of the racks upon selective movement of the rows along the length of the floor.

12. The facility of claim 8 wherein the door means are selectively disposed along the wall of the building so as to provide access to the unoccupied floor area upon selective movement of one or more of the rows of racks along the length of the floor area.

13. The facility of claim 8 wherein the unoccupied floor area is further selected to be of such a size as to be accessible to the door means upon movement of one or more of the rows of racks along the length of the floor area.

14. The facility of claim 1 wherein the racks comprising a row are connected along their lengthwise sides forming rows which are rollably movable in a lengthwise direction along the floor area.

15. The facility of claim 3 further comprising motor means for drivably moving the racks across the length of the floor area.

16. The facility of claim 3 further comprising a row of stationary racks arranged along one or both of the lengthwise sides of the rectangular floor area, the stationary racks having a certain length, width and height and being divided from top to bottom into storage slots, the slots extending the length of the racks and being open and accessible from one width end for inserting and removing objects into and from the width ends of the stationary racks, the width ends of the racks facing the rectangular floor area.

17. The facility of claim 3 wherein a row of racks comprises a series of spaced vertical supports interconnected by a series of spaced horizontal supports.

18. The facility of claim 14 wherein the racks are mounted on tracks for lengthwise movement within the rectangular floor area, the tracks extending the length of the floor area in a direction substantially parallel to the wall of the building.

19. The facility of claim 5 wherein a row of racks comprises a series of spaced vertical supports interconnected by a series of spaced horizontal supports.

20. The facility of claim 3 wherein at least two rows of racks are disposed within the enclosed rectangular floor area and wherein as many rows of racks are disposed within the enclosed floor area as will fit along the length of the floor area and leave a portion of the floor area unoccupied which is of a size at least sufficient to provide access from the door means to the width ends of the racks upon selective movement of the rows along the length of the floor.

21. The facility of claim 7 wherein the door means are selectively disposed along the wall of the building so as to provide access to the unoccupied floor area upon selective movement of one or more of the rows of racks along the length of the floor area.

22. The facility of claim 7 wherein a row of racks comprises a series of spaced vertical supports interconnected by a series of spaced horizontal supports.

23. The facility of claim 7 wherein the unoccupied floor area is further selected to be of such a size as to be accessible to the door means upon movement of one or more of the rows of racks along the length of the floor area.

24. The facility of claim 13 further comprising motor means for drivably moving the racks across the length of the floor area.

25. The facility of claim 13 wherein a row of racks comprises a series of spaced vertical supports interconnected by a series of spaced horizontal supports.

26. The facility of claim 13 further comprising a row of stationary racks arranged along one or both of the lengthwise sides of the rectangular floor area, the stationary racks having a certain length, width and height and being divided from top to bottom into storage slots, the slots extending the length of the racks and being open and accessible from one width end for inserting and removing objects into and from the width ends of the stationary racks, the width ends of the racks facing the rectangular floor area.

27. The facility of claim 23 wherein a row of racks comprises a series of spaced vertical supports interconnected by a series of spaced horizontal supports.

28. A high density boat storage facility comprising:

an enclosed rectangular floor area of certain length and width;

a plurality of rectangular storage racks of certain height divided from top to bottom into storage slots, the slots extending the rectangular length of the racks and being open and accessible for inserting and removing boats into and from the width ends of the racks;

the racks being disposed within the enclosed rectangular floor area and including means for rolling the racks along the floor area;

a wall disposed substantially parallel to a lengthwise side of the rectangular floor area, the wall including door means selectively disposed along the length of the wall for providing access to all of the width ends of all the racks;

the racks being rollably moveable along the length of the enclosed rectangular floor area for providing access to the width ends of the racks from the door means.

* * * * *